United States Patent [19]

Kanjo et al.

[11] 4,236,424

[45] Dec. 2, 1980

[54] HAND BRAKE FOR RAILWAY VEHICLES

[75] Inventors: Wajih Kanjo, Midlothian; Richard J. Housman, Dolton; Scott L. Natschke, Kankakee, all of Ill.

[73] Assignee: American Standard Inc., Chicago, Ill.

[21] Appl. No.: 10,447

[22] Filed: Feb. 8, 1979

[51] Int. Cl.[3] ..... G05G 1/08

[52] U.S. Cl. ..... 74/505

[58] Field of Search ..... 74/505, 506; 188/821; 254/149

[56] References Cited

U.S. PATENT DOCUMENTS

| | | | |
|---|---|---|---|
| 2,000,089 | 5/1935 | Miller et al. | 74/505 |
| 2,188,521 | 1/1940 | Zane | 74/505 |
| 2,381,135 | 8/1945 | Olander | 74/505 |
| 3,293,936 | 12/1966 | Wilson et al. | 74/505 |

FOREIGN PATENT DOCUMENTS

| | | | |
|---|---|---|---|
| 1314485 | 11/1961 | France | 74/505 |

*Primary Examiner*—Kenneth Dorner

*Attorney, Agent, or Firm*—R. S. Visk; R. W. McIntire, Jr.

[57] ABSTRACT

A ratchet operated chain-type hand brake for railway vehicles characterized by a housing for enclosing the ratchet mechanism and a chain wind-up drum. The ratchet mechanism includes an operating pawl for taking up the chain and a holding pawl for holding the chain take-up, both pawls being in constant engagement with a single ratchet to eliminate lost motion of the operating handle.

4 Claims, 3 Drawing Figures

HAND BRAKE FOR RAILWAY VEHICLES

BACKGROUND OF THE INVENTION

In some of the presently known ratchet operated chain-type hand brakes for railway vehicles, the ratchet mechanism and other moving parts are exposed to the elements, thereby presenting the risk of freeze-up during extremely wet, cold weather conditions. The ratchet mechanism in presently known hand brakes may also comprise a complex ratchet system including respective ratchets for the operating pawl and the holding pawls, said ratchets, although being connected for cooperative operation, may permit some lost motion therebetween during such time that the brake is being set.

SUMMARY OF THE INVENTION

The object of the present invention is to provide a ratchet operated chain-type hand brake for railway vehicles which minimizes lost motion in the ratchet mechanism and which protects said ratchet mechanism and other moving parts from freezing and other harmful weather conditions by being fully enclosed.

Briefly, the invention comprises a common ratchet engageable and rotatable by an operating pawl for rotating a take-up or winding drum during rotation of an operating handle in one direction, said common ratchet being engageable by a holding pawl and maintained thereby in its rotated position during rotation of the operating handle in an opposite direction to an original position from which it may be rotated again in the one direction for further take-up operation. A release handle is provided with two cam surfaces engageable with the holding pawl and the operating pawl and effective for releasing engagement of said pawls sequentially from the ratchet for effecting release of the brake application.

DESCRIPTION AND OPERATION

Figure 1:
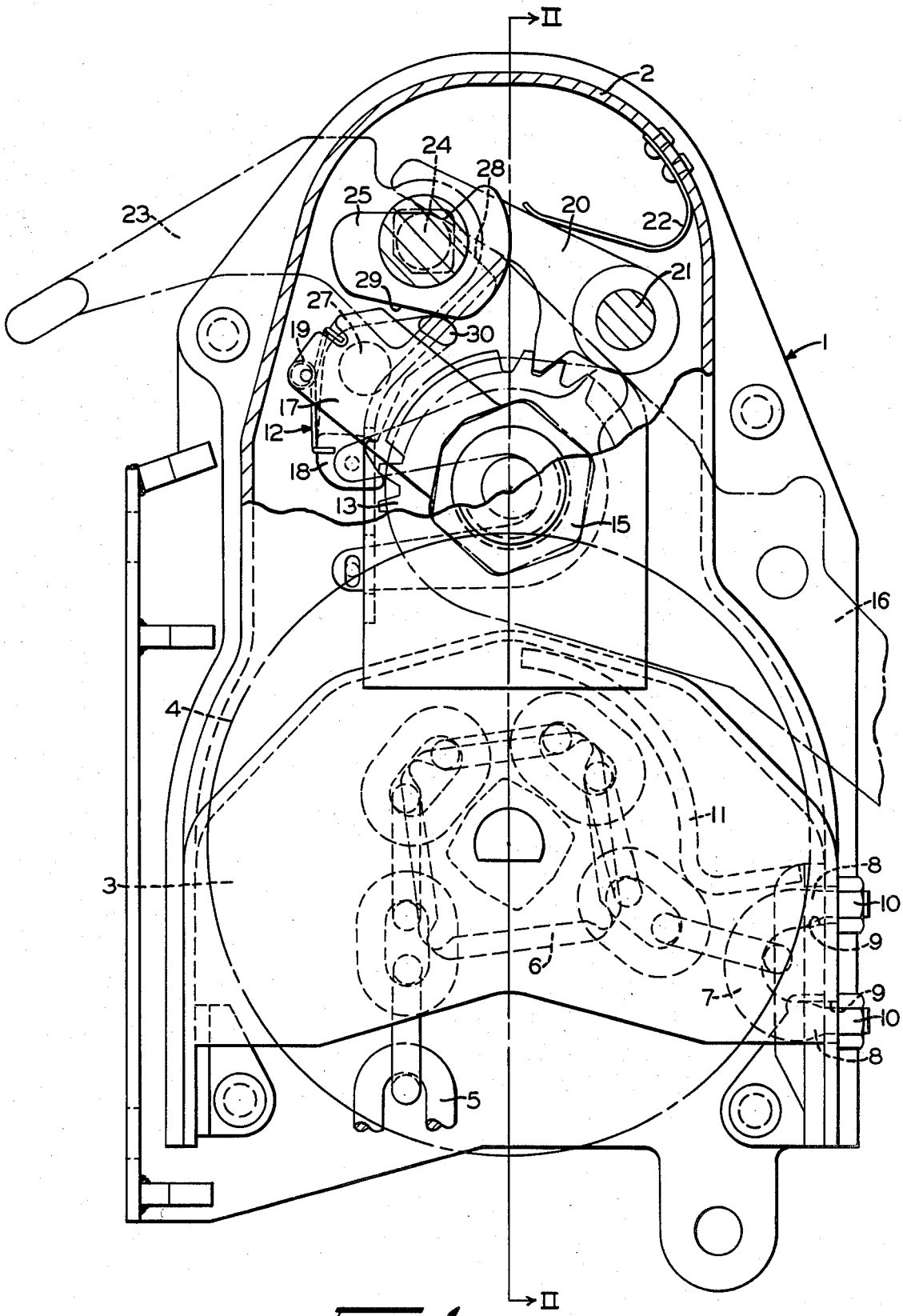
FIG. 1 is an elevational view, partly in section and partly in outline, of a ratchet operated chain-type hand brake embodying the invention.

As shown in FIG. 1, a hand brake device embodying the invention comprises a housing or casing assembly 1 including a back plate 2. A winding drum 3 encircled peripherally by an annular gear 4 is rotatably disposed in the lower portion of housing assembly 1, as viewed in the drawing. The hand brake device is conveniently mounted at one end of the car and connected by one end of a tension chain 5 to the brake rigging (not shown), the other end of said chain being engaged by a double sprocket 6 formed on drum 3 (see FIG. 2 also) and anchored by a U-bolt 7 secured in housing 1. Legs 8 of U-bolt 7 are tapered while respective holes or bores 9 in housing 2, into which said legs are disposed, are of slightly smaller diameter than the largest diameter of said legs, so that when respective nuts 10 are drawn up, the larger diameter portions of said legs are jammed tightly against the opening of the holes to prevent any movement of the legs in the holes. Clockwise rotation of drum 3, in a manner to be hereinafter disclosed, causes sprocket 6 to wind chain 5 into the drum and thereby place tension and brake-applying force on the brake rigging to cause the brakes to be applied.

A chain guide 11 arcuately partly surrounds chain 5 adjacent the end anchored on U-bolt 7 for a purpose to be hereinafter explained.

Figure 2:
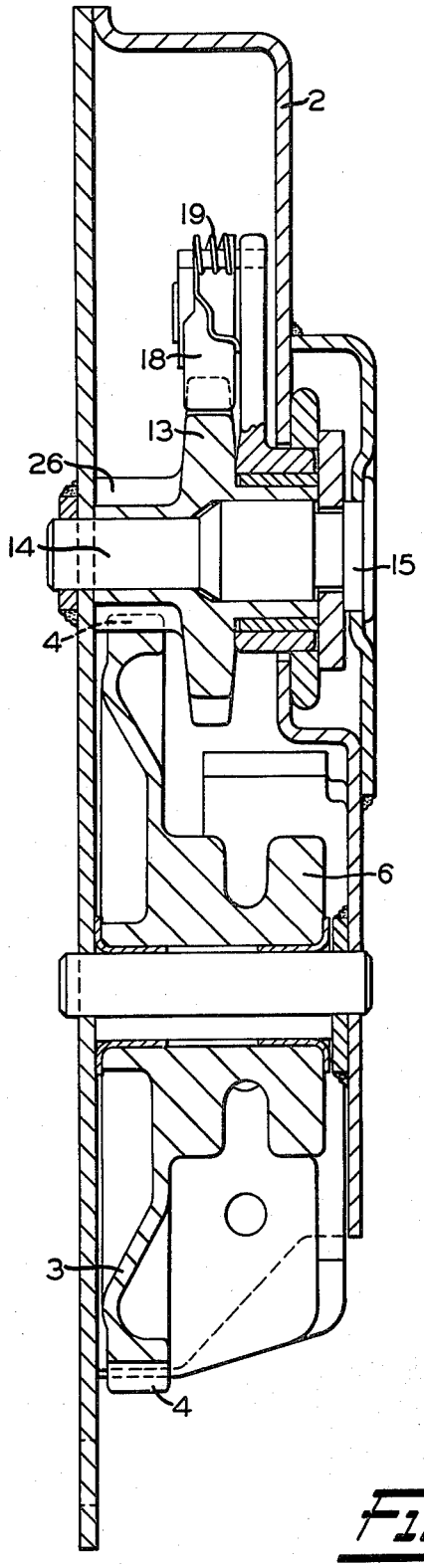
FIG. 2 is a sectional view taken along line II—II of FIG. 1 as viewed in the direction indicated by the arrows.

An operating ratchet mechanism, operably disposed in the upper portion of housing assembly 1, comprises an operating pawl arm assembly 12 and an annular ratchet wheel 13 rotatably supported on a shaft 14 (see FIG. 2). The right hand end, as viewed in FIG. 2, of shaft 14 is irregularly shaped to conform to the same shape as a hole 15 in housing 1 for locking the shaft against rotation. One end of an operating handle 16 (shown in phantom outline in FIG. 1) has radially affixed thereto for rotation therewith a support arm 17 forming a part of operating pawl arm assembly 12. An operating pawl 18 is pivotally carried by support arm 17 and is biased by a spring 19 toward engagement with ratchet 13.

Figure 3:
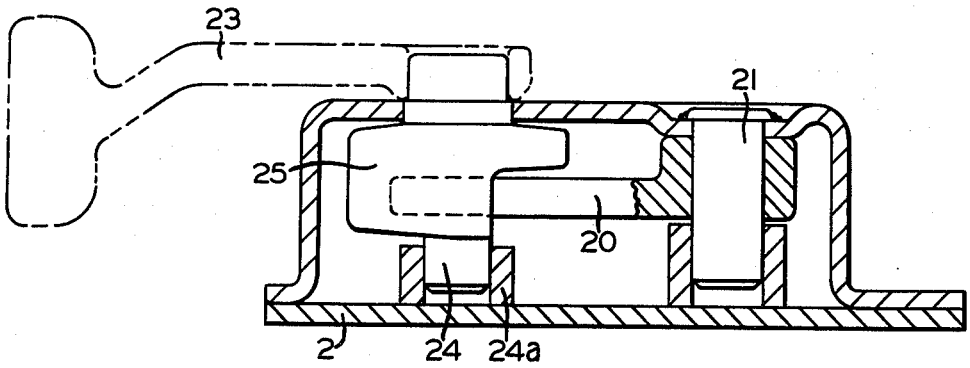
FIG. 3 is a sectional view taken along line III—III of FIG. 1 as viewed in the direction indicated by the arrows.

A holding pawl 20 is pivotally carried by a pin 21 secured in housing 1 (see FIG. 3) said holding pawl being situated so as to be biased by a spring 22 into engagement with ratchet 13.

A release handle 23, also shown in phantom outline in FIG. 1, is attached at one end to a release shaft 24 (see FIG. 3) extending outwardly through the front of housing assembly 1. A cam member 25 is carried at the same end of release handle 23, in coaxial relation with release shaft 24 and rotatable with said release handle for a purpose to be hereinafter disclosed. The rearward end of release shaft 24 is rotatably supported in an axially aligned bushing 24*a* fixed to back plate 2.

A gear pinion 26, in axial alignment with ratchet 13, is formed integrally with said ratchet so as to mesh with gear 4 formed on drum 3, as best seen in FIG. 2.

In operation, in order to make an application, operating handle 16 is rotated counterclockwise out of a normal rest position, as viewed in FIG. 1, which in turn through support arm 17, causes operating pawl assembly 12 to be rotated therewith. Operating pawl 18 thus engages ratchet wheel 13 to effect counterclockwise rotation thereof and, therefore, of pinion 26. Pinion 26, being meshed with gear 4 of drum 3, causes clockwise rotation of said gear and drum, and, therefore, of sprocket 6. Chain 5 is thus wound onto drum 3 to exert tension on the brake rigging (not shown) and thereby effect an application of the brakes in a well known manner.

During counterclockwise rotation of handle 16 and, therefore, of ratchet wheel 13, as above described, ratcheting action occurs between said ratchet wheel and holding pawl 20. Upon return of handle 16 to its normal position in which it is shown (clockwise rotation), holding pawl 20 engages ratchet wheel 13 to hold it stationary and, therefore, hold drum 3 in its attained take-up position, while operating pawl 18, by pivoting about a pivot pin 27, ratchets over said ratchet wheel.

In order to release the brake application, release handle 23 is rotated in a clockwise direction. Cam member 25 has two cam surfaces 28 and 29 formed thereon and are situated such that operating pawl 18 is disengaged from ratchet wheel 13 ahead of holding pawl 20. As release handle 23 is rotated clockwise, initial rotation causes cam surface 29 to engage operating pawl 18 at surface 30 and thereby effect disengagement of said operating pawl from ratchet wheel 13. Continued clockwise rotation of handle 23 causes cam surface 28 to engage the extremity of holding pawl 20 to disengage said pawl 20 from ratchet 13 thereby effecting release of both pawls from ratchet 13 and allowing rapid clockwise rotation of ratchet and counterclockwise rotation of winding drum 3 to effect the release of tension on the chain and brake rigging.

Release of the brake application, as above described, occurs at a rapid rate. During such release, chain guide 11 serves two purposes: (a) to keep the chain 5 within drum 3, and (b) to absorb part of the energy during quick release by frictionally retarding chain thrust against said chain guide, thereby directing the chain thrust in an axially aligned direction with U-bolt 2 and preventing lateral thrust and possible damage thereto.

A locking member 31 serves to hold operating handle 16 to operating arm 17 and shaft 14 in the brake assembly.

Having now described the invention, what we claim as new and desire to secure by Letters Patent, is:

1. A ratchet operated hand brake device for railway vehicles equipped with brake rigging effective when subjected to tension for effecting a brake application, said hand brake device comprising:

(a) a casing conveniently mountable on the vehicle;

(b) a tension chain having one end anchored by a U-bolt secured to said casing by a pair of parallel legs, the other end of said chain being connectable to apparatus to which tension is to be applied such as the brake rigging, for example;

(c) a winding drum rotatable in said casing in one direction for winding the chain onto said drum and placing tension thereon, and being rotatable in an opposite direction for releasing said tension from said chain;

(d) ratchet means operably disposed in said casing and including a common ratchet wheel engageable by an operating pawl assembly and a holding pawl, said ratchet wheel having a pinion formed thereon and rotatable therewith in mesh with a gear formed on said drum;

(e) an operating handle carrying said operating pawl assembly at one end and effective, when rotated in one direction out of a normal inoperative position, for causing engagement of said operating pawl with said ratchet wheel and effecting rotation thereof and of said pinion in a corresponding direction for rotating said drum in its said one direction;

(f) said operating handle being returnable to its said normal position by rotation thereof in an opposite direction relative to its rotation in said one direction during which time said operating pawl ratchets relative to said ratchet wheel and said holding pawl engages the ratchet wheel for holding it against rotation; and (g) a release handle including cam means engageable with both said holding pawl and said operating pawl, said cam means being effective, upon rotation of said release handle, for sequentially disengaging said operating pawl and said holding pawl, in the order named, from the ratchet wheel and consequently releasing tension from said chain.

2. A ratchet operated hand brake device, as set forth in claim 1, further characterized by an arcuate chain guide fixed in said casing concentrically within said drum for making frictional contact with said chain and absorbing the thrust energy thereof during retraction of the chain from said drum upon release of the tension acting thereon.

3. A ratchet operated hand brake, as set forth in claim 2, wherein said chain guide has one end anchored to said casing adjacent said U-bolt for directing said thrust energy of the chain during brake release action in an axially aligned direction relative to said U-bolt.

4. A ratchet operated hand brake device, as set forth in claim 3, wherein said legs of said U-bolt are tapered and are secured in respective bores formed in said casing by a pair of nuts and respective threads formed on the legs, said bores being of a lesser diameter than the largest diameter of the tapered legs for tightly securing the legs in said bores without relative movement.

* * * * *